United States Patent [19]

St. Clair

[11] 4,169,333

[45] Oct. 2, 1979

[54] MODEL AIRCRAFT LAUNCHER

[76] Inventor: Oba L. St. Clair, 5035 Larkwood La., Eugene, Oreg. 97405

[21] Appl. No.: 861,677

[22] Filed: Dec. 19, 1977

[51] Int. Cl.[2] ..... A63H 27/14

[52] U.S. Cl. ..... 46/74 R; 46/78

[58] Field of Search ..... 46/75, 76 R, 78; 244/63

[56] References Cited

U.S. PATENT DOCUMENTS

| | | | |
|---|---|---|---|
| 2,957,651 | 10/1960 | Figgins et al. | 244/63 |
| 3,057,113 | 10/1962 | Baker | 46/78 |
| 3,154,883 | 11/1964 | Gardella | 46/78 |

*Primary Examiner*—Louis G. Mancene
*Assistant Examiner*—Robert F. Cutting
*Attorney, Agent, or Firm*—Kolisch, Hartwell, Dickinson & Stuart

[57] ABSTRACT

A model aircraft launcher for releasing a self-propelled model aircraft by remote control. The launcher comprises an elongate arm pivotally anchored to a stationary surface, a spring arm swingably attached to one end of the elongate arm for spring-action swinging motion between a hold position and a release position, and a release member with an attached remote control cord. As the cord is pulled, the release member slides over an end portion of the spring arm, initially exerting a spring bias on the arm, and finally disengaging the arm, allowing the arm to swing by spring action to its release position. The aircraft, attached to a line held by the spring arm, is thereby released for takeoff.

5 Claims, 6 Drawing Figures

MODEL AIRCRAFT LAUNCHER

BACKGROUND AND SUMMARY OF THE INVENTION

This invention relates to model aircraft launching devices, and in particular to such devices whereby the aircraft operator can release an aircraft for takeoff by remote control.

Often, the launching of a self-powered model aircraft requires more than one person. Once launched, however, the aircraft is handled by a single person.

There is thus a need for an aircraft launching device by which an operator can launch a model aircraft without the assistance of a second person.

A general object of the present invention is to provide a simple and effective model aircraft launching device usable by a single person (operator) for launching an aircraft by remote control.

Another object of the invention is to provide such a launcher that is pivotally anchored to a stationary surface and which restrains the aircraft by a line attached to the aircraft.

A further object of the invention is to provide an aircraft launcher having a simple spring-action release mechanism which can be actuated by pulling a remote control cord in any direction.

Still another object of the invention is to provide an aircraft launcher of the type generally outlined which includes a safety latch to prevent unintentional actuation of the device.

These and other objects and features of the invention will become more fully apparent as the description which now follows is read in conjunction with the accompanying drawings.

DETAILED DESCRIPTION OF THE INVENTION

Figures 1, 2:
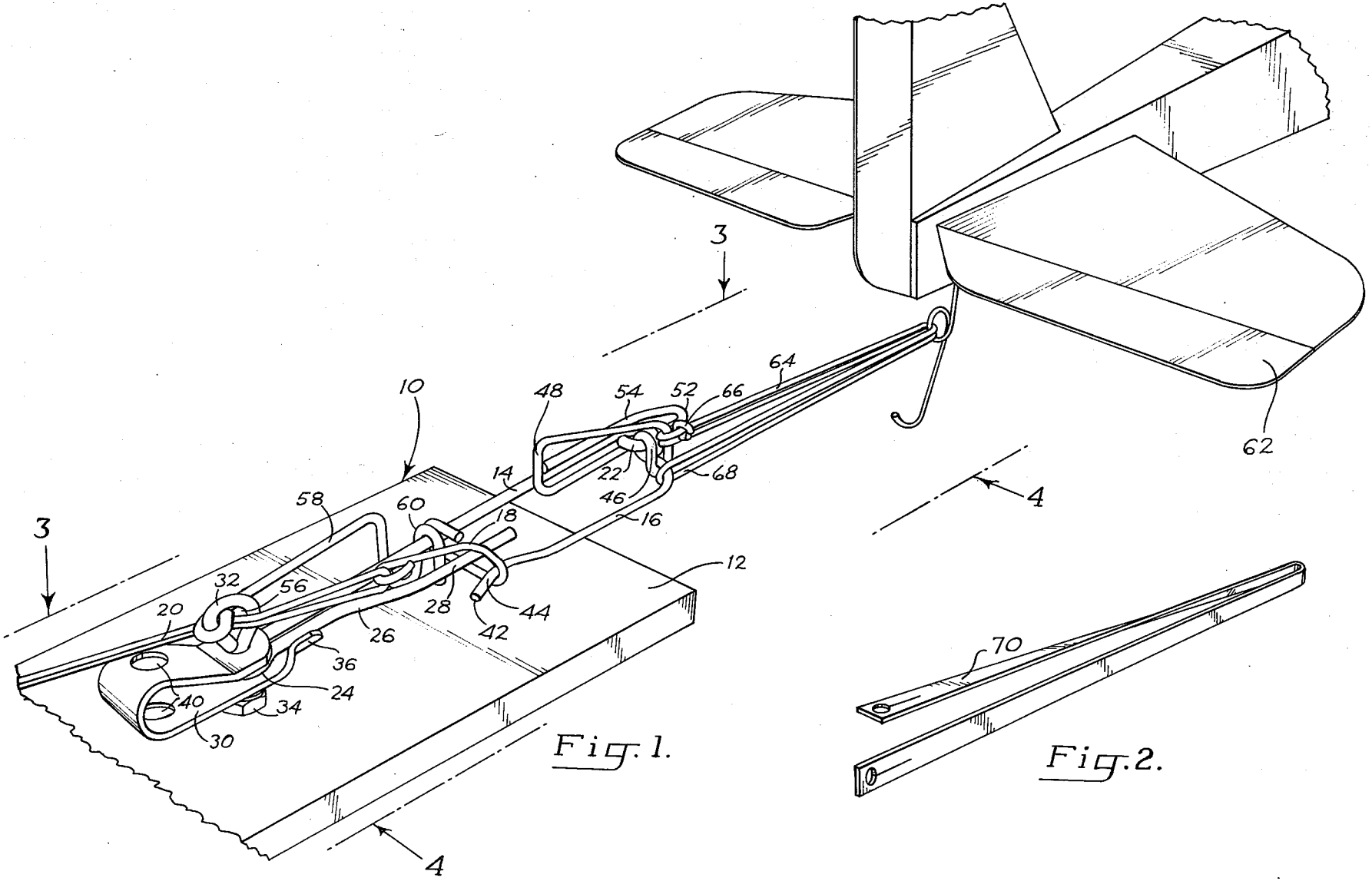
FIG. 1 is a fragmentary perspective view of the launcher of the invention connected through one type of restraining strap for use with a model aircraft.
FIG. 2 is a perspective view of an alternate type of restraining strap.

Referring now to FIG. 1, the model aircraft launcher 10 of the present invention is shown pivotally attached to the front portion of a launching platform 12. The launcher comprises an elongate arm 14, a spring/gripper arm 16 swingably attached to the elongate arm, and a release member 18 which may be moved rearwardly along the elongate arm by a remote control cord 20.

Figure 4:
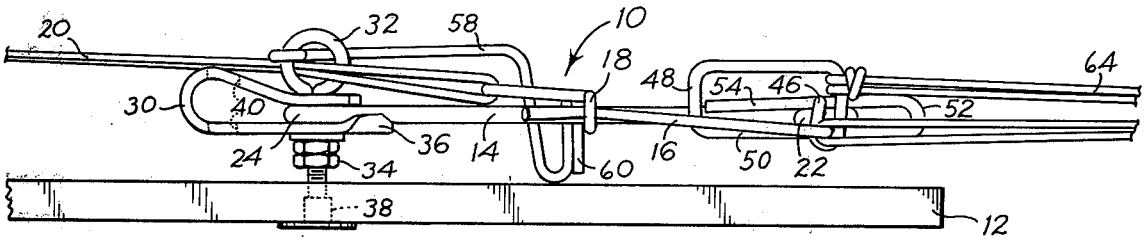
FIG. 4 is a side elevation view of the launcher in its hold position, taken along line 4—4 of FIG. 1.

The elongate arm, or mounting member, is preferably fashioned from a cold-rolled steel wire and has a front closed loop 22 and a rear open extended loop 24 (FIGS. 1 and 4). The extended portion of loop 24 is angled outwardly at 26 to form a guide portion 28.

The launcher is pivotally attached to launching platform 12 through elongate arm loop 24. This loop is secured in a pivot clamp 30 by eye bolt 32 and clamping nuts 34 (FIG. 4), being braced within clamp 30 by the upwardly flanged clamp sides 36. Eye bolt 32 is pivotally attached to platform 12 by threaded attachment to a staple nut 38 which is embedded in the lower side of the platform. Thus mounted, arm loops 22 and 24 lie in a substantially horizontal plane within which arm 14 can pivot. As an alternate means of attaching launcher 10 to a stationary surface, pivot clamp 30 can be secured, through clamp holes 40, to a vertically projecting stake (not shown) supported in an appropriate takeoff surface such as blacktop or hard ground.

Figure 3:
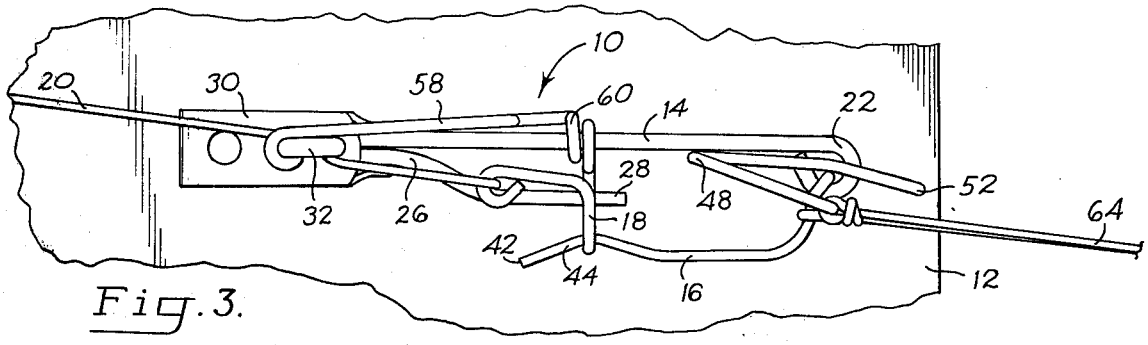
FIG. 3 is a top plan view of the launcher in its hold position, taken along line 3—3 of FIG. 1.
Figure 6:
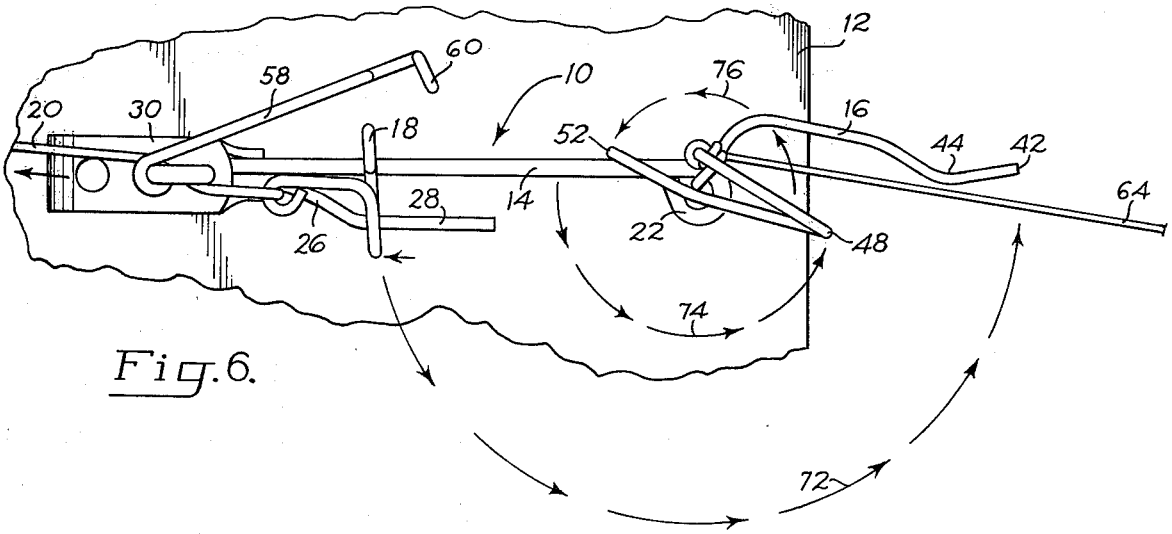
FIG. 6 is a view similar to FIG. 3 illustrating the launcher immediately upon release.

Spring arm 16 as swingably attached to elongate arm loop 22 for swinging motion between a hold or gripping position, as shown in FIG. 3, and a release position, shown in FIG. 6. Spring arm 16 has spring characteristics and is preferably fashioned from a single piece of spring bronze wire to form, sequentially from wire end 42, spring-bias-increasing portion 44, attachment loop 46, hold position brace 48, lower guide arm with the spring arm in the hold position shown for it in FIG. 1, the front portion thereof defines a crook which receives line end 68; 50, release position brace 52 and upward guide arm 54. The overlapping relationship of guide arms 50 and 54 with end loop 22 constrains the spring arm to swing in a substantially horizontal plane. Hold position brace 48 and release position brace 52 limit the extent of clockwise swinging motion in the hold position and counterclockwise swinging motion in the release position, respectively.

Figure 5:
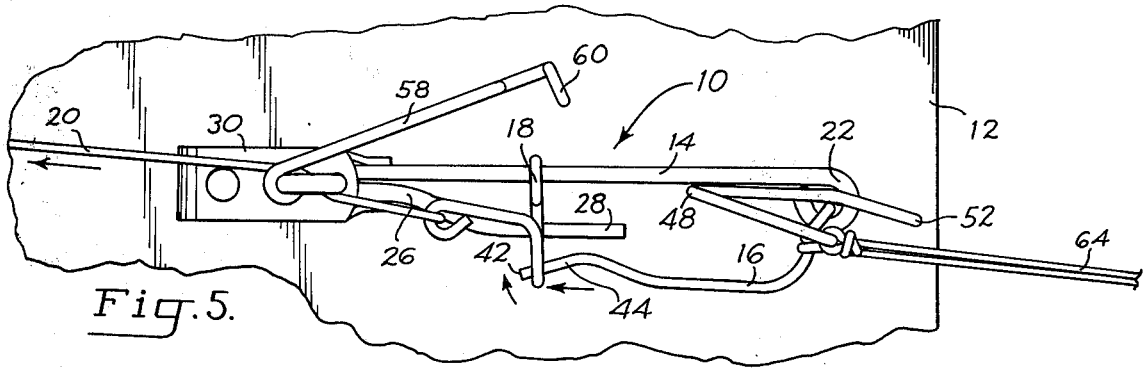
FIG. 5 is a view similar to FIG. 3 illustrating the launcher during actuation—prior to release.

Spring arm 16 is secured in its hold position (FIG. 3) by release member 18, and is released by drawing member 18 rearwardly as shown in FIG. 5. The release member is a wire loop slidably attached to the elongate arm and guided thereon in a substantially horizontal plane by guide portion 28. Remote control cord 20 is secured to the rearward portion of the release member and passes through the eye 56 of eye bolt 32. As can be appreciated from the drawings, eye bolt 32 functions as a pulley to direct the pulling force applied to the remote control cord from any direction to a rearwardly-directed force acting on the release member. The launcher can thus be activated for release by pulling the cord in any direction.

The present invention additionally provides a safety latch 58 swingably attached to the eye bolt 32 as shown in FIG. 1. The distal end of the latch 58 is an inverted U-loop 60 (FIG. 4) that engages elongate arm 14 just rearwardly of the release member when the spring arm is in its hold position, as is illustrated in FIG. 3. When engaged, the latch prevents the release member from being pulled rearwardly, thus preventing activation of the launcher.

In operation, the model aircraft launcher is pivotally attached to an appropriate stationary surface such as launching pad 12. A model aircraft 62 is secured to a launcher by a line 64 as shown in FIG. 1. One end 66 of line 64 is permanently affixed to the launcher and the free looped line end 68 is releasably attached to the spring arm. Alternatively, the aircraft may be attached to the launcher by a strap 70 such as is shown in FIG. 2, with one end of strap 70 being permanently affixed to the rear of the aircraft by conventional means and the other free end being releasably attached to the spring arm.

With the free end of the strap looped over the spring arm, the spring arm is swung fully clockwise to the position where hold position brace 48 engages elongate arm 14, whereupon the spring arm end 42 is moved under tension further in the clockwise direction until release member 18 can be slipped over the spring arm end. Member 18 then assumes the position shown in FIG. 3, engaging the spring arm under slight spring tension at the vertex of spring-bias-increasing portion 44. To prevent accidental release of the aircraft before the aircraft is ready for launching, safety latch 58 may be engaged on the elongate arm.

After releasing the safety latch, the operator launches the aircraft by pulling remote control cord 20, thus drawing the release member rearwardly, as shown in FIG. 5. As member 18 is pulled along portion 44, the spring arm is further biased, causing the spring arm to swing rapidly by spring action to its release position when member 18 is pulled over spring arm end 42. This release action throws line 64 free of the spring arm, releasing the aircraft for takeoff. The motion of the spring arm during release at 42, 48 and 52 is shown by arcs 72, 74 and 76, respectively, in FIG. 6.

Thus, a model aircraft launching device having simple, rapid and reliable release mechanism has been disclosed. Although specific embodiments have been shown and described, it will be obvious to those skilled in the arts that various modifications may be made without departing from the spirit of the invention.

It is claimed and desired to secure by Letters Patent:

1. A model aircraft launcher comprising an elongate mounting member, a spring/gripper arm defining a gripping crook swingably attached to said mounting member for spring-action swinging between a gripping position wherein said crook is adapted to hold an aircraft by a line attached both to the crook and to the aircraft, and a releasing position wherein such a line is released from the crook, a release member mounted for movement between a first position holding said arm in its said gripping position and a second position releasing said arm, and operating means remotely activatable to shift said release member from its said first position toward its said second position.

2. The launcher of claim 1 which further comprises a safety latch selectively engageable with said mounting member for preventing movement of said release member away from its said first position under the influence of said operating means.

3. The launcher of claim 1, wherein said release member is slidably mounted on said mounting member.

4. The launcher of claim 1, wherein said arm includes a spring-bias-increasing portion engaged by said release member during movement of the latter between its said first and second positions, said portion, as a result of such engagement, increasing spring action in said arm.

5. A model aircraft launcher comprising an elongate mounting member, a spring arm swingably attached to said mounting member for spring-action swinging between a hold position wherein an aircraft is held by a line attached to the arm and a release position wherein such a line is released from the arm, a release member mounted for movement between a first position engaging said arm in its said hold position and a second position releasing said arm, operating means remotely activatable to shift said release member from its said first position toward its said second position, and a safety latch selectively engageable with said mounting member for preventing movement of said release member away from its said first position under the influence of said operating means.

* * * * *